United States Patent [19]

McFadyen

[11] Patent Number: 4,799,598

[45] Date of Patent: Jan. 24, 1989

[54] SELF-SEALING CLOSURE

[75] Inventor: Robert C. McFadyen, Chester, England

[73] Assignee: Lever Brothers Company, New York, N.Y.

[21] Appl. No.: 206,984

[22] Filed: Jun. 13, 1988

Related U.S. Application Data

[63] Continuation of Ser. No. 118,681, Nov. 9, 1987, abandoned.

[30] Foreign Application Priority Data

Nov. 10, 1986 [GB] United Kingdom ..... 8626765

[51] Int. Cl.[4] ..... B65D 51/16

[52] U.S. Cl. ..... 215/260; 215/270; 220/366; 220/367

[58] Field of Search ..... 215/260, 270, 271, 310, 215/311; 220/366, 367, 203, 209

[56] References Cited

U.S. PATENT DOCUMENTS

| | | | |
|---|---|---|---|
| 1,576,763 | 3/1926 | Ingram | 215/260 |
| 2,576,917 | 12/1951 | Berner | 215/260 |
| 4,210,255 | 7/1980 | Pan | 215/260 X |
| 4,228,914 | 10/1980 | Sanderson | 215/260 X |
| 4,480,759 | 11/1984 | Behrens et al. | 215/260 X |
| 4,601,413 | 7/1986 | Krawagna | 222/498 |
| 4,705,188 | 11/1987 | Rahn | 220/367 |

FOREIGN PATENT DOCUMENTS 0048421 11/1983 European Pat. Off. .

*Primary Examiner*—Stephen P. Garbe
*Assistant Examiner*—Nova Stucker
*Attorney, Agent, or Firm*—G. J. McGowan, Jr.; J. J. Farrell

[57] ABSTRACT

A self-closing container closure which opens in response to overpressure in the container comprises a sealing plug connected to the closure by a plurality of flexible webs, the overall length of each of the webs being at least equal to the maximum distance between the attachments of the webs to the plug and closure as the plug moves between the open and closed positions.

10 Claims, 4 Drawing Sheets

SELF-SEALING CLOSURE

Figure 1:
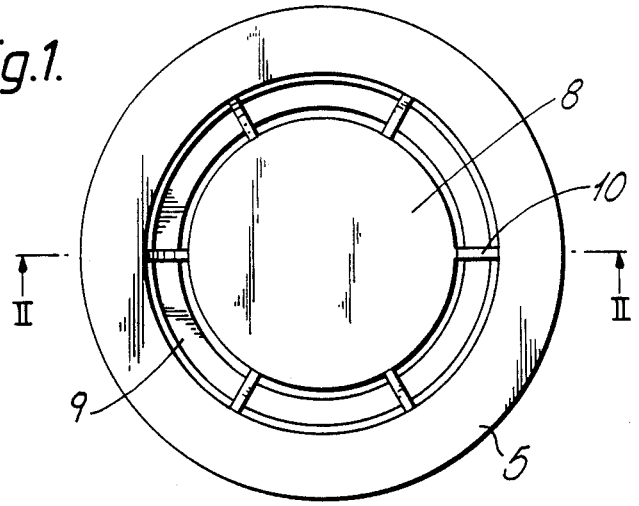

This is a continuation application of Ser. No. 118,681, filed Nov. 9, 1987, now abandoned.

This invention relates to a self-sealing container closure which is openable when the internal container pressure exceeds the external pressure by a set amount and recloses when the internal pressure has been reduced and particularly to such a closure which embodies a minimum number of separate components and can be designed to open at a wide range of internal overpressures.

According to the present invention, there is provided a self-sealing container closure adapted to close an opening in a container, comprising a securing portion having a skirt, fastening means on the skirt which cooperates with fastening means on the container to secure the closure over the container opening, an inwardly extending flange at one end of the skirt and a sealing plug biased to a first position to seal the container and moveable to a second open position in a plane parallel to the first position, the plug being inwardly spaced from the flange to form a gap there between, a plurality of flexible spoke-like webs extending across the gap and attached at opposite ends to the plug and flange, the overall length of each of the webs being at least equal to the maximum distance between respective attachments as the plug moves between the first and second positions, the webs resiliently urging the plug from the second position to the first position.

Thus the closure can comprise a single component, which can be readily manufactured e.g. by injection moulding in a plastics material. The material can be relatively rigid material such as polypropylene or polyethylene enabling the skirt and fastening means to be sufficiently rigid without using unduly thick sections. Nevertheless, the desired flexibility of the sealing plug to move relative to the skirt to open the container at a predetermined over-pressure within the container can be achieved by selecting the number, size and geometric arrangement of the webs. The webs either bend along their length or at the attachments to permit movement of the sealing plug relative to the skirt between the first and second positions and the flexibility of the web connection between the plug and skirt does not depend on the elastic properties of the closure material.

Conveniently, the webs are straight when the plug is in the first closed position and bend as the plug moves to the second open position. In the closed position, the sealing plug is disposed in a plane parallel to but spaced from the plane of the flange by a distance determined by the length of the webs. As the plug moves towards the plane of the flange to the open position, the webs distort or bend to effectively shorten the length of the webs by an amount corresponding to the change in distance between the attachments. Depending upon the overpressure at which the closure is intended to open it can b difficult to obtain the desired flexibility of the webs and sensitivity of opening of the closure with such an arrangement without having unduly long webs. Straight webs are therefore preferably arranged to extend transversely across the gap between the plug and flange, so that as the plug moves between the first and second positions, the plug is rotated slightly relative to the flange. By arranging the webs transversely across the cap, they can be longer for a given width of gap, and hence more readily bent. Furthermore, the amount of bending necessary as the plug moves between the first and second positions is reduced since the webs effect a slight rotational movement of the plug relative to the flange as the plane of the plug changes relative to the plane of the flange whilst the length of the webs, and hence the distance between the attachments of the webs, remains constant.

In an alternative construction which allows the webs to have a longer length for a given gap width, the webs are curved when the plug is in the first closed position and bend towards a straight condition as the plug moves to the second open position. The attachments of respective webs to the flange and plug can be arranged such that the plug moves between the first and second positions without any rotational movement.

In a preferred form of the invention, the webs extend transversely across the gap in a common plane, and are curved in said common plane when the plug is in the first closed position. This combination provides for maximum length of web for a given gap width. As the plug moves towards the second open position, the webs tend to straighten and the sealing plug rotates relative to the flange.

The sealing plug can seal with a sealing surface formed on an insert secured within the container opening. A particularly effective sealing of the container can be effected when the sealing surface is conical.

A convenient form of fastening means on the skirt and container comprises a screw thread.

A closure according to the present invention can be used as a self-sealing dispensing valve on a squeezable container which is squeezed to dispense the contents. An over cap can conveniently be provided it having a single orifice through which the contents pass after passing from the container mouth through the gap in the closure.

However, a preferred from of the invention is a venting closure for the packaging of substances which can generate gas during storage e.g. household chemicals such as sanitary cleaners and bleaches containing hypochlorite or oxygen. A number of previous proposals for such venting closures have been made and commonly allow the gas to escape via a tortuous path around the inter-engaging screw threads of the bottle closure. Whilst such previous proposals have been adequate for hypochlorite based products, the amount of gas generated by an oxygen based product under similar storage conditions is greater than with the hypochlorite based product. The improved venting means of the present invention can accommodate greater amounts of gas being generated because the escaping gas can pass to atmosphere without having to pass around the inter-engaging screw threads.

Packages for household chemicals are often required to have a so called child-proof closure to prevent small children opening the package. An example of such a child-proof closure has been described in German Patent Specification No. 2,550,538, and in U.S. Pat. No. 4,480,759 there is described such a closure incorporating means by which gas can escape from the container via the screw thread.

In a particularly preferred embodiment the present invention provides a child-proof closure for the threaded mouth of a container comprising a screw cap having a threaded skirt for mounting on the container mouth, the crown of the cap being formed by an inwardly extending flange and a sealing plug for sealing the container mouth connected to the flange by a plurality of flexible curved webs each connected to the flange forward of the respective attachment to the sealing plug in the direction of rotation of the cap as it is applied to the container mouth, an over cap attached to the screw cap with axial play therebetween, both the over cap and the screw cap having projections or projections and grooves which, within the axial play, can engage in each other, those sides of the projections or grooves which touch each other when the cap is screwed down being made as carriers, while those sides of the projections or grooves which touch each other when the cap is screwed off act as wedges, and in such a way that, when being screwed down, the screw cap is carried by the outside cap but when being screwed off this only happens when an axial pressure is exerted on the outside cap and directed against the container. When being screwed down rotation of the over cap is transmitted to the screw cap by the projections or the projections and grooves contacting each other as carriers so that the over cap can be simply rotated to rotate the screw cap until it is secure on the container mouth. When the over cap is rotated in the opposite direction to remove the closure those sides of the projections or grooves which touch each other act as wedges so that the over cap tends to move axially relative to the screw cap until the projections or grooves disengage. Only by the application of an axial force in the direction of the container can contact between the projections or grooves be maintained to exert a rotational force on the screw cap to remove it.

Figure 2:
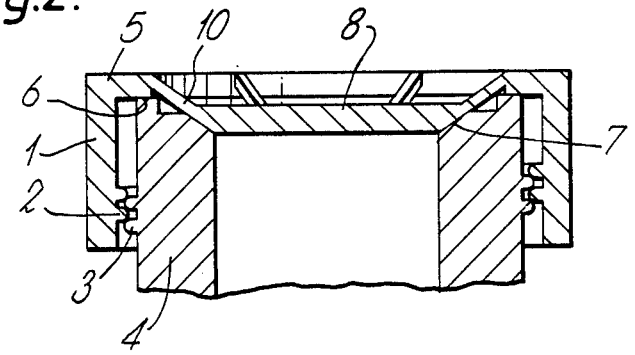
Figure 3:
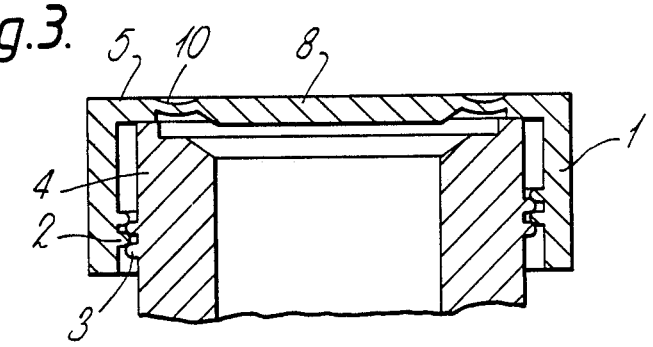
Figure 4:
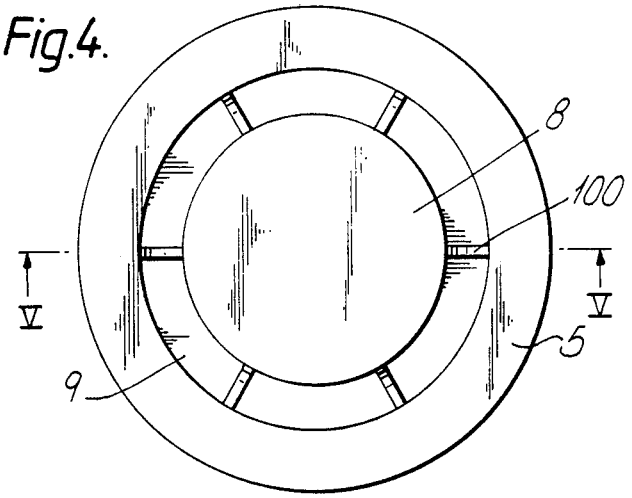
Figure 5:
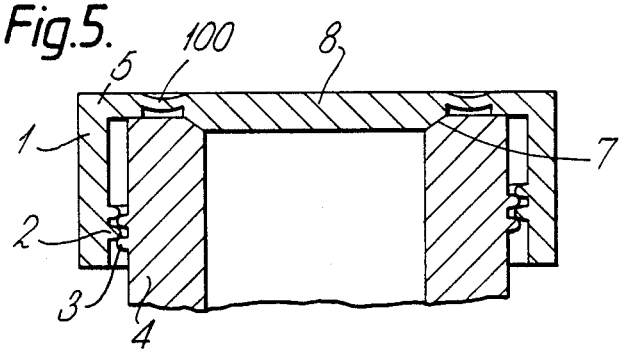
Figure 6:
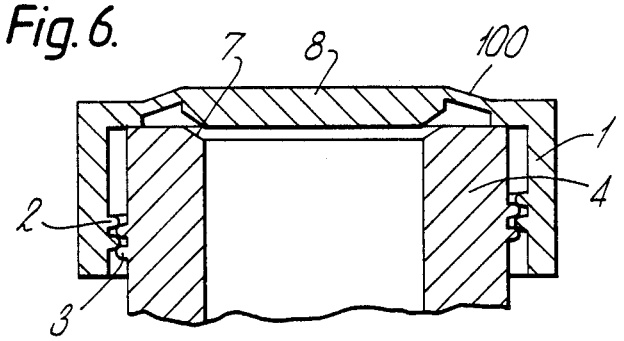
Figure 9:
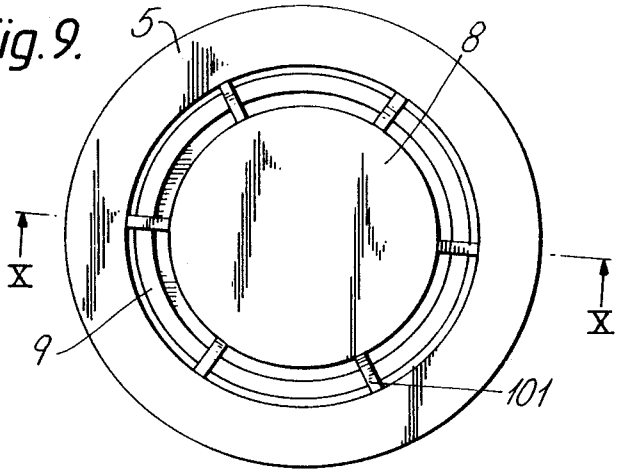
Figure 10:
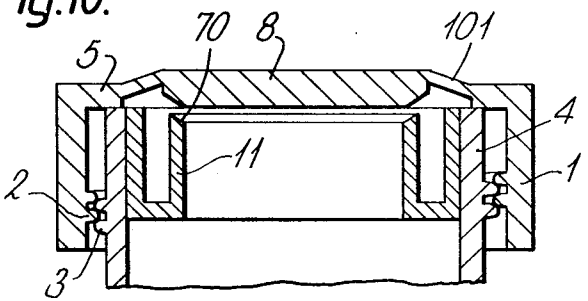
Figure 7:
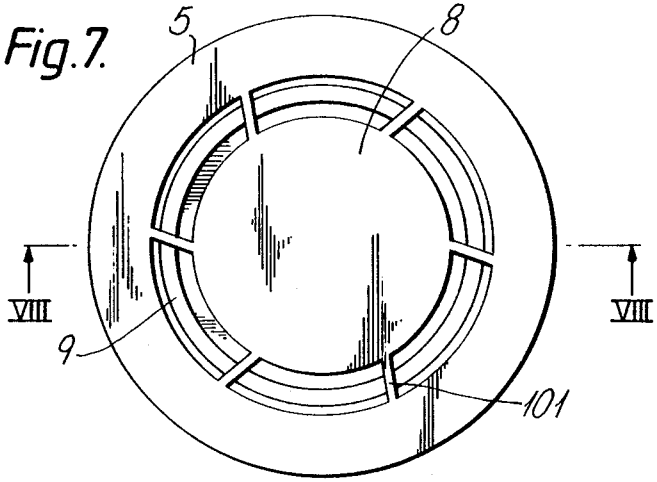
Figure 8:
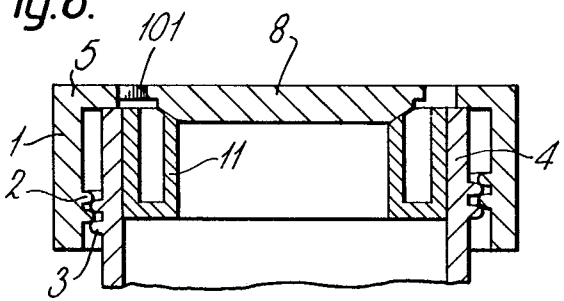
Figure 13:
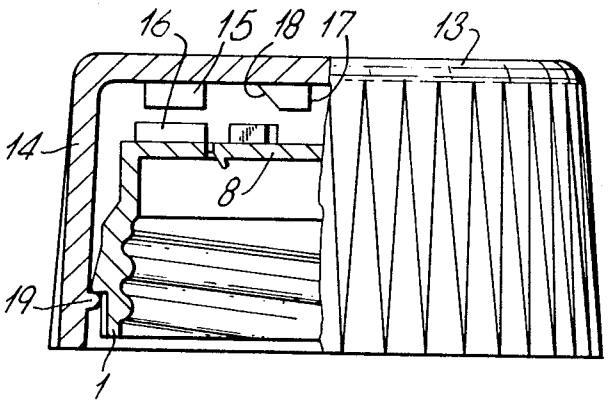
Figure 11:
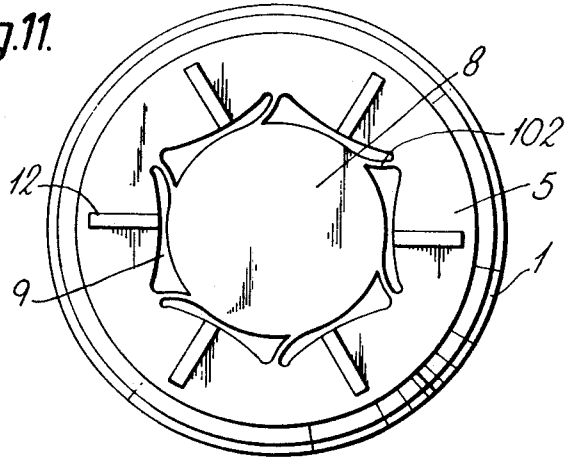
Figure 12:
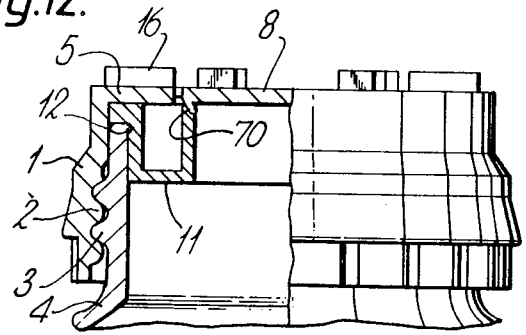

The invention will now be more particularly described with reference to the accompanying diagrammatic drawings in which:

FIG. 1 is a plan view of one form of closure according to the invention,

FIG. 2 is a sectional elevation along the line II—II of the closure of FIG. 1 in the closed position, FIG. 3 is a view similar to FIG. 2 showing the closure in the open position, FIG. 4 is a plan view of an alternative embodiment of closure according to the invention, FIG. 5 is a sectional elevation along the line V—V in FIG. 4 showing the closure in the closed position, FIG. 6 is a view similar to FIG. 5 showing the closure in the open position, FIG. 7 is a plan view of a further embodiment of closure according to the invention, FIG. 8 is a sectional elevation of the closure of FIG. 7 along the line VIII—VIII showing the closure in the closed position, FIG. 9 is a plan view of the closure of FIG. 7 and 8 in the open position, FIG. 10 is a sectional elevation along the line X—X in FIG. 9, FIG. 11 is a plan view of yet another embodiment of the invention incorporated in a child-resistant closure, FIG. 12 is a part sectional elevation of the closure of FIG. 11, and FIG. 13 is a view similar to FIG. 12 showing the over cap in position.

Referring now to FIGS. 1 and 2 the closure comprises a skirt 1 having fastening means 2 in the form of an internal thread which engages with a screw thread 3 on the mouth 4 of a container (not shown). The upper end of the skirt 1 is provided with an inwardly extending flange 5 which as shown in FIG. 2 abuts the top 6 of the container mouth. The container mouth is provided with a conical sealing surface 7 and a sealing plug 8 closes against the surface 7 as shown in FIG. 2 to close the container. The sealing plug is smaller than the inner diameter of the flange 5 to leave a gap 9 therebetween as seen in FIG. 1 and is connected to the flange 5 by six flexible spoke-like webs 10 which extend radially across the gap 9 when seen in FIG. 1. As seen in FIG. 2 the sealing plug is disposed below the plane of the flange in the closed position and the webs 10 are substantially straight.

When the over pressure in the container increases sufficiently, the sealing plug 8 rises as shown in FIG. 3 to the open position in which the inside of the container is in communication with the outside of the container via the gaps 9 between the webs 10. In the open position the webs 10 are forced to bend as the distance between their attachments to the plug and flange reduces, the length of each of the webs being the maximum when the plug is in the closed position. When the over pressure in the container reduces the tendency of the webs to revert to the straight condition resiliently urges the plug to the closed position.

Referring now to FIGS. 4 and 5 there is shown an alternative embodiment in which the closure comprises as before a skirt 1 secured by co-operating screw threads 2 and 3 to a container mouth 4. The closure has a flange 5 and a sealing plug 8 with a gap 9 therebetween. In this embodiment the sealing plug 8 is connected to the flange 5 by webs 100. In the closed position as shown in FIG. 5, the webs 100 are curved, the sealing plug engaging the conical surface 7 of the mouth of the container when the sealing plug is in substantially the same plane as the flange 5. When the over pressure in the container increases to a sufficient level, the sealing plug rises to lie in a plane above the plane of the flange 5 and falls again when the pressure reduces.

As seen in FIG. 6, the webs 100 are straight when the sealing plug is in the open position. When in this position the length of each of the webs corresponds to the maximum distance between their respective attachments to the plug and flange. Thus the webs 100 are caused to bend to the straight condition as the closure opens.

In each of the embodiments hereinbefore described, movement of the sealing plug between the open and closed positions requires the webs to bend. Where the gap 9 is necessarily narrow, it can be difficult to proportion the size of the webs such that the closure opens with the required degree of sensitivity to over pressure within the container.

Referring now to FIGS. 7 to 10, there is shown a closure substantially as previously described having a skirt 1 attached by cooperating screw threads 2 and 3 to a container mouth 4. A conical sealing surface 70 i provided on an insert 11 secured within the mouth of the container. The closure has an inwardly extending flange 5 and a sealing plug 8 is disposed within the flange 5 leaving a gap 9 there between. The plug 8 is connected to the flange 5 by six flexible spoke-like webs 101. When the sealing plug 8 is in the closed position as shown in FIG. 8, the plane of the plug is substantially that of the flange 5 whereas when the plug is in the open position as shown in FIG. 10, the plug is above the flange 5. Thus the maximum distance between the attachments of the webs 101 to the plug 8 and flange 5 is when the plug is in the open position. In the closed position of the plug as seen in FIG. 7, the webs 101 extend transversely across the gap 9. As the plug rises to the open position the plug rotates slightly in the clockwise direction as seen in FIG. 7 and 9 until the webs extend substantially radially across the angular gap 9. For a given width of gap 9 the length of the webs 101 is greater than in the previous embodiments which facilitates the design of their proportions to provide the desired sensitivity. As shown in FIGS. 7 and 9, the flexibility of the webs 101 is largely by virtue of their attachment to the flange 5 and plug 8 but it will be appreciated that they may also bend along their length.

Whilst the invention has been described with reference to closures which are threadably attached to a container mouth it will be appreciated that any other form of fitting e.g. snap fitting, may be used and that the closure need not necessarily be round.

The self-sealing closures hereinbefore described can be used either as a venting closure to vent over pressure created within a container by the contained product, or as a self-sealing dispensing closure on a squeeze to use container. Particularly in the latter case, an over cap can be provided having a single orifice through the crown through which the product passes after passing through the gaps 9 between the webs.

FIGS. 11 to 13 show a further embodiment of the invention incorporated in a child-proof closure. The container mouth 4 is provided with an insert 11 on which is formed the conical sealing surface 70, the insert 11 being snap fitted within the container mouth by a co-operating ridge and groove indicated at 12. The container mouth has an external thread 3 which is engaged by a thread 2 formed on the inside of skirt 1 of the closure. The closure has a flange 5 and a sealing plug 8 therein. The sealing plug is connected to the flange 5 by webs 102 which are curved as seen in FIG. 11. The webs are connected to the flange 5 at attachment points forward of their respective attachments to the plug 8 in the direction of rotation of the cap 1 as it is applied by securing to the container mouth. The generally transverse direction of the webs and their curving facilitates the design of the webs to achieve the desired amount of flexibility. Gaps 9 exist between the sealing plug 8 and the flange 5 as before.

As shown in FIG. 12, the plug is in the closed position and is in substantially the same plane as flange 5. When the closure opens, the plug 8 rises so that the distance between the attachments of the webs 102 to the flange 5 and plug 8 increases when seen in the direction of the sectional elevation of FIG. 12. To achieve this the webs 102 bend towards the straight position in which they extend more radially towards the axis of the closure when the plug is in the open position. In the open position the webs urge the plug towards the closed position.

The child-proof mechanism is provided as in German Patents Specification No. 2550538 and comprises six projections 16 extending upwardly from the flange 5. In the underside of the crown 13 of an over cap 14 as shown in FIG. 13 are six similar projections 15 having at one side a vertical edge 17 and at the other side an inclined edge 18. The over cap is located on the closure by an annular rib 19 whilst permitting axial play of the over cap relative to the closure. When the closure is applied to a container mouth the vertical edges 17 of the projections 15 in the over cap engage with one side of the projections 16 on the flange 5 and allow the closure to be simply screwed on the container mouth. When the over cap is rotated in the opposite direction to remove the closure from the container mouth, the inclined edges 18 engage with the opposite edges of the projections 16. Unless sufficient axial force is applied to the over cap in the direction of one container the over cap rises relative to the closure until the projections 15 disengage from the projections 16 and the over cap rotates without rotating the closure.

Whilst no apertures are provided in the crown 13 of the over cap 14, it will be appreciated that gas venting through the gaps 9 can readily escape by passing downwards between the over cap and the skirt 1.

Closures according to the invention can be made of any suitable material, e.g. of polypropylene or polyethylene. A venting closure according to FIGS. 11 to 13 is particularly suitable for bottles in which liquid cleaning compositions containing oxygen are packaged.

It will be understood that n the closed position of each of the embodiments, as well as in the open position the plug is biased to the closed position by the webs.

I claim:

1. A self-sealing container closure adapted to close an opening in a container, comprising a securing portion having a skirt, fastening means on the skirt which co-operates with fastening means on the container to secure the closure over the container opening, an inwardly extending flange at one end of the skirt and a sealing plug biased to a first position to seal the container and moveable to a second open position in a plane parallel to the first position, the plug being inwardly spaced from the flange to form a gap there between, a plurality of flexible spoke-like webs extending across the gap and attached at opposite ends to the plug and flange, the overall length of each of the webs being at least equal to the maximum distance between respective attachments as the plug moves between the first and second positions, the webs resiliently urging the plug from the second position to the first position.

2. A closure according to claim 1 in which the webs are straight when the plug is in the first closed position and bend as the plug moves to the second open position.

3. A closure according to claim 1 in which the webs extend transversely across the gap between the plug and flange, so that as the plug moves between the first and second positions, the plug is rotated slightly relative to the flange.

4. A closure according to claim 1 in which the webs are curved when the plug is in the first closed position and bend towards a straight condition as the plug moves to the second open position.

5. A closure according to claim 4 in which the webs extend transversely across the gap in a common plane, and are curved in said common plane when the plug is in the first closed position.

6. A closure according to claim 1 in which the sealing plug seals with a sealing surface formed on an insert secured within the container opening.

7. A closure according to claim 6 in which the sealing surface is conical.

8. A child-proof closure for the threaded mouth of a container comprising a screw cap having a threaded skirt for mounting on the container mouth, the crown of the cap being formed by an inwardly extending flange and a sealing plug connected to the flange by a plurality of flexible curved webs which urge the plug to seal the container mouth each web being connected to the flange forward of the respective attachment to the sealing plug in the direction of rotation of the cap as it is applied to the container mouth, an over cap attached to the screw cap with axial play therebetween, both the over cap and the screw cap having cooperating means which, within the axial play, can engage in each other, those sides of said cooperating means which touch each other when the cap is screwed down being made as carriers, while those sides of said cooperating means which touch each other when the cap is screwed off act as wedges, and in such a way that, when being screwed down, the screw cap is carried by the outside cap but when being screwed off this only happens when an axial pressure is exerted on the outside cap and directed against the container.

9. The child-proof closure of claim 8, wherein said cooperating means comprise projections.

10. The child-proof closure of claim 8, wherein said cooperating means comprise projections and grooves.

* * * * *